US007281483B1

(12) United States Patent
Horton, III et al.

(10) Patent No.: US 7,281,483 B1
(45) Date of Patent: Oct. 16, 2007

(54) EMERGENCY BALLAST SYSTEM FOR SEMI-SUBMERSIBLE DRILLING RIGS

(75) Inventors: Edward E. Horton, III, Houston, TX (US); James V. Maher, Houston, TX (US)

(73) Assignee: AGR Deepwater Development Systems, Inc, Houston, TX (US)

( * ) Notice: Subject to any disclaimer, the term of this patent is extended or adjusted under 35 U.S.C. 154(b) by 0 days.

(21) Appl. No.: 11/566,612

(22) Filed: Dec. 4, 2006

Related U.S. Application Data

(63) Continuation-in-part of application No. 11/504,475, filed on Sep. 5, 2006.

(51) Int. Cl.
*B63B 35/44* (2006.01)

(52) U.S. Cl. ..... 114/264

(58) Field of Classification Search ..... 114/264
See application file for complete search history.

(56) References Cited

U.S. PATENT DOCUMENTS 6,935,810 B2 * 8/2005 Horton, III ..... 405/200

2003/0221603 A1 * 12/2003 Horton ..... 114/264

* cited by examiner

*Primary Examiner*—Stephen Avila
(74) *Attorney, Agent, or Firm*—Conley Rose, P.C.

(57) ABSTRACT

A semi-submersible vessel comprising a plurality of stabilizing columns, a deck disposed between the tops of the columns, at least one void tank in one stabilizing column, at least one active variable ballast compartment disposed below the void tank, at least one emergency water ballast compartment disposed at the bottom of the stabilizing column below the active variable ballast compartment and below the void tank, wherein the emergency water ballast compartment is flooded during normal operating conditions, a pressurized air source for expelling water from the emergency ballast compartment, at least one control valve connected to the pressurized air source for rapidly passing air into the emergency water ballast compartment, and at least one port in the emergency water ballast compartment for expelling water from the emergency water ballast compartment.

9 Claims, 2 Drawing Sheets

EMERGENCY BALLAST SYSTEM FOR SEMI-SUBMERSIBLE DRILLING RIGS

CROSS-REFERENCE TO RELATED APPLICATIONS

This patent application is a continuation-in-part application that claims the benefit, under 35 USC § 120, of the prior non-provisional application Ser. No. 11/504,475, which was filled Sep. 5, 2006. The prior co-pending non-provisional application is incorporated by reference along with its appendices.

FIELD

The present embodiments relate generally to a semi-submersible drilling or production vessel having at least one emergency water ballast compartment disposed below an active variable ballast compartment and below a void talk.

BACKGROUND

Semi-submersible drilling and production rigs and vessels are often prone to destabilization, especially when damaged or exposed to inclement weather or unsafe water conditions. The destabilization of a semi-submersible vessel or rig can cause damage or destruction to the vessel, can cause injury to personnel, or even death, and can damage the environment.

A need has existed for a semi-submersible vessel or rig that provides improved stability and safety.

A need has existed for a semi-submersible vessel or rig provided with the capacity to self-right to an acceptable floating position, preventing the consequences of operator error or incapacity, and allowing personnel to evacuate during inclement weather or unsafe water conditions while the vessel retains the ability to remain stabilized.

A need has existed for an improved ballast system that prevents inversion, which is a common, and often catastrophic problem in known semi-submersibles.

A need has existed for a semi-submersible vessel or rig that is safer for both personnel and the environment.

A need has existed for an efficient rig for use in deepwater.

The present embodiments meet these needs.

BRIEF DESCRIPTION OF THE DRAWINGS

The detailed description will be better understood in conjunction with the accompanying drawings as follows.

Figure 1:
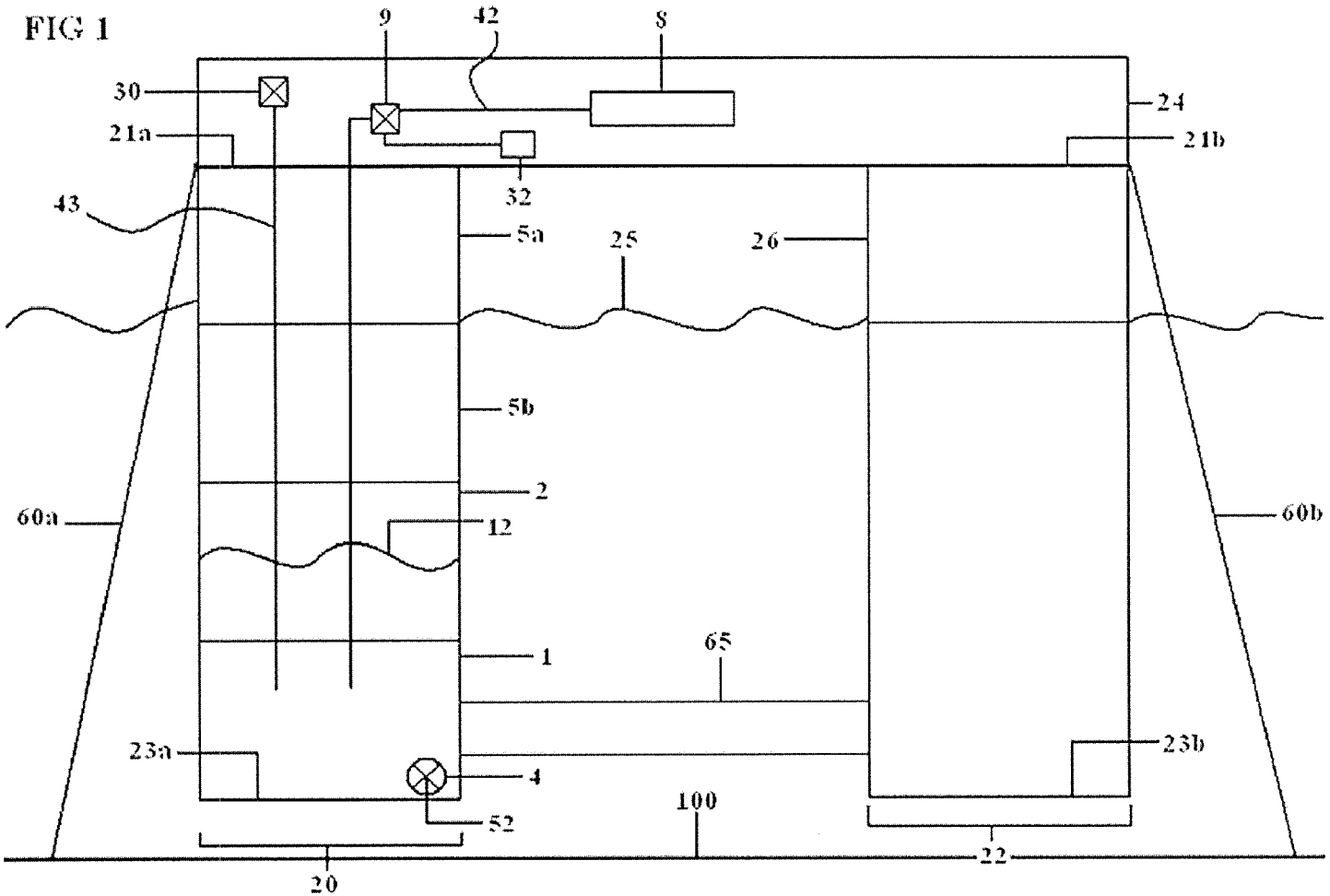
FIG. 1 depicts a front cross-sectional view of an embodiment of the semi-submersible.

The present embodiments are detailed below with reference to the listed Figures.

DETAILED DESCRIPTION OF THE EMBODIMENTS

Before explaining the present embodiments in detail, it is to be understood that the embodiments are not limited to the particular embodiments and that they can be practiced or carried out in various ways.

One of the benefits of this emergency stabilizing system is that the system provides a significant amount of additional buoyancy in a required stabilizing column, acting quickly to counteract the effects of damage or accidental flooding of part of a vessel. This invention provides significant safety advantages over standard semi-submersibles.

Another benefit of the emergency ballasting system for a semi-submersible vessel is that the vessel is provided with the capability to self-right back to an acceptable floating position, negating the potentially catastrophic consequences of human error or incapacity. The invention provides a rig that is significantly safer than other semi-submersibles because it has an improved ballast system.

The present invention permits an efficient rig for use in deepwater.

The embodiments of the current invention saves lives by increasing the safety of the vessel well beyond the capabilities of known semi-submersibles by providing a superior emergency ballast system and by providing a recovery system for potentially catastrophic failure modes that can be brought on by operator ballasting errors.

One embodiment of the invention relates to a semi-submersible drilling or production vessel having a plurality of stabilizing columns, with each column having a top and a bottom. The vessel can have three columns, four or more columns and be usable herein.

The vessel can have a deck disposed between the tops of the plurality of stabilizing columns forming a vessel with a waterline. The deck can be disposed over the waterline.

At least one of the stabilizing columns can have at least one void tank. However, each stabilizing column could have a void tank, or groups of columns could have void tanks, and groups of columns could omit void tanks.

The void tank could have a capacity of ranging from 10,000 cubic feet to 500,000 cubic feet. In an embodiment, the void tank is square when viewed in cross-section, with a tank height ranging from 20 feet to 50 feet, and constructed of typical ship-type stiffened steel plate fabrication using a typical shipbuilding mild steel material.

In the stabilizing columns with the void tanks, at least one active variable ballast compartment can be located disposed below the void tank. The active variable ballast compartment could have a capacity, shape, and material composition similar to that of the void tank.

The stabilizing columns with the void tanks additionally can have at least one emergency water ballast compartment disposed at the bottom of the stabilizing column. This emergency water ballast compartment can be located below the active variable ballast compartment and below the void tank in the column.

The emergency water ballast compartment can be flooded during normal operating conditions with liquids such as seawater. The emergency water ballast compartment can have a size that ranges from 10,000 cubic feet to 500,000 cubic feet. More than one emergency water ballast compartment can be located in locations such as the bottom of a stabilizing column.

Each emergency water ballast compartment can be connected to a pressurized air source that is positioned above the waterline of the vessel and generally near the tops of the stabilizing columns containing the emergency water ballast compartments, wherein the pressurized air source is adapted for expelling water from the emergency water ballast compartments. The pressurized air source can be air from a standard air compressor. A specification for such a compressor could be 150 psi at 800 cubic feet per minute (cfm), similar to those found for standard construction applications.

Alternatively, the pressurized air source can be from pressurized air cylinders, such as a pre-pressurized, contained air source. The pressure of the air from the air source must be at a pressure greater than that of the corresponding pressure of the sea water adjacent the emergency water ballast compartment to ensure rapid expulsion of sea water. The amount of air required to displace the water from the tank can be substantially equal to that of the water in the tank if the storage pressure is substantially equal to the local hydrostatic pressure at the bottom of the emergency ballast compartment. Thus, it can be convenient to design the air source with a significantly higher pressure to reduce the size of the air source.

In an alternate embodiment, it can be contemplated that the flow rate for rapid expulsion of sea water from the emergency water ballast compartment can be a rate faster than the rate of sea water entering the void tank above the emergency water ballast compartment.

The system includes at least one control valve connected to the pressurized air source for rapidly passing air into the emergency water ballast compartment. The control valve can be located on the inlet line to the emergency water ballast compartment from the pressurized air source. Optionally, a vent can be connected to the emergency water ballast compartment for expelling the air passed into the emergency water ballast compartment, allowing water to reenter the emergency water ballast compartment.

At least one port can be located in the emergency water ballast compartment for expelling water from the emergency water ballast compartment.

A port cover can be used over each port. The port cover prevents the reentry of water into the emergency water ballast compartment. Additionally, the port covers can be extremely helpful in reducing the transport of oxygen, which slows the corrosion process in the event that the emergency water ballast compartment is at least partially empty of seawater.

In an embodiment, the system can further include at least one sensor for actuating the control valve. The sensor would indicate when the vessel is listing or tilting, or otherwise destabilizing beyond a preset limit.

A preset limit can be any amount of listing or tilting manually indicated, inputted, or programmed by an individual, a standard amount, such as twenty degrees, a standard amount determined by the design of the sensor, or the preset limit can be determined based on dimensions, materials and other qualities specific to an individual semi-submersible vessel or rig.

The system can further include a processor with memory and computer instructions having preset limits on listing of the vessel, which are engaged by the sensor. The control valve can be actuated by the processor automatically when the sensor provides data to the computer instructions to indicate the vessel has listed past the preset limit.

In another embodiment, it can be contemplated that at least one emergency water ballast compartment can be located in the bottom of each of the corner columns of such a drilling rig.

In still another embodiment, it can be contemplated that the emergency water ballast compartment is a pressure equalized tank. A pressure equalized tank can be one that takes advantage of the similarity of external and internal pressure to reduce the required structural design of the stiffened panel construction. Given the fact that water can be displaced with air that is a similar pressure to the external pressure, the structural design can require significantly less steel than would be required if the pressure equalized tank were instead a void tank at the same depth below the waterline.

In another embodiment, it can be contemplated that in at least one of the stabilizing columns, a void tank is disposed above and below a waterline of the vessel.

Now with reference to the figures, FIG. 1 shows a deep draft semi-submersible structure, a floating vessel 40. FIG. 1 shows a front cross-sectional view of the vessel 40. This view shows two vertically oriented buoyant columns 20 and 22, connected by a deck 24 at the top of the columns.

Each column has a top and a bottom. Column 20 has top 21*a* and bottom 23*a*. Column 22 has top 21*b* and bottom 23*b*. An optional heave plate 65 can be used between the columns at the ends closest to the sea floor 100. Various mooring lines 60*a*, 60*b*, can be secured to the vessel 40 to anchor vessel 40 to the sea floor. The vessel may not need mooring lines and may be able to position itself using a dynamic positioning system, which employs global positioning systems and thrusters to keep a steady position over a defined point on the sea floor. Each mooring line can be secured to a stabilizing column with a fairlead.

Figure 2:
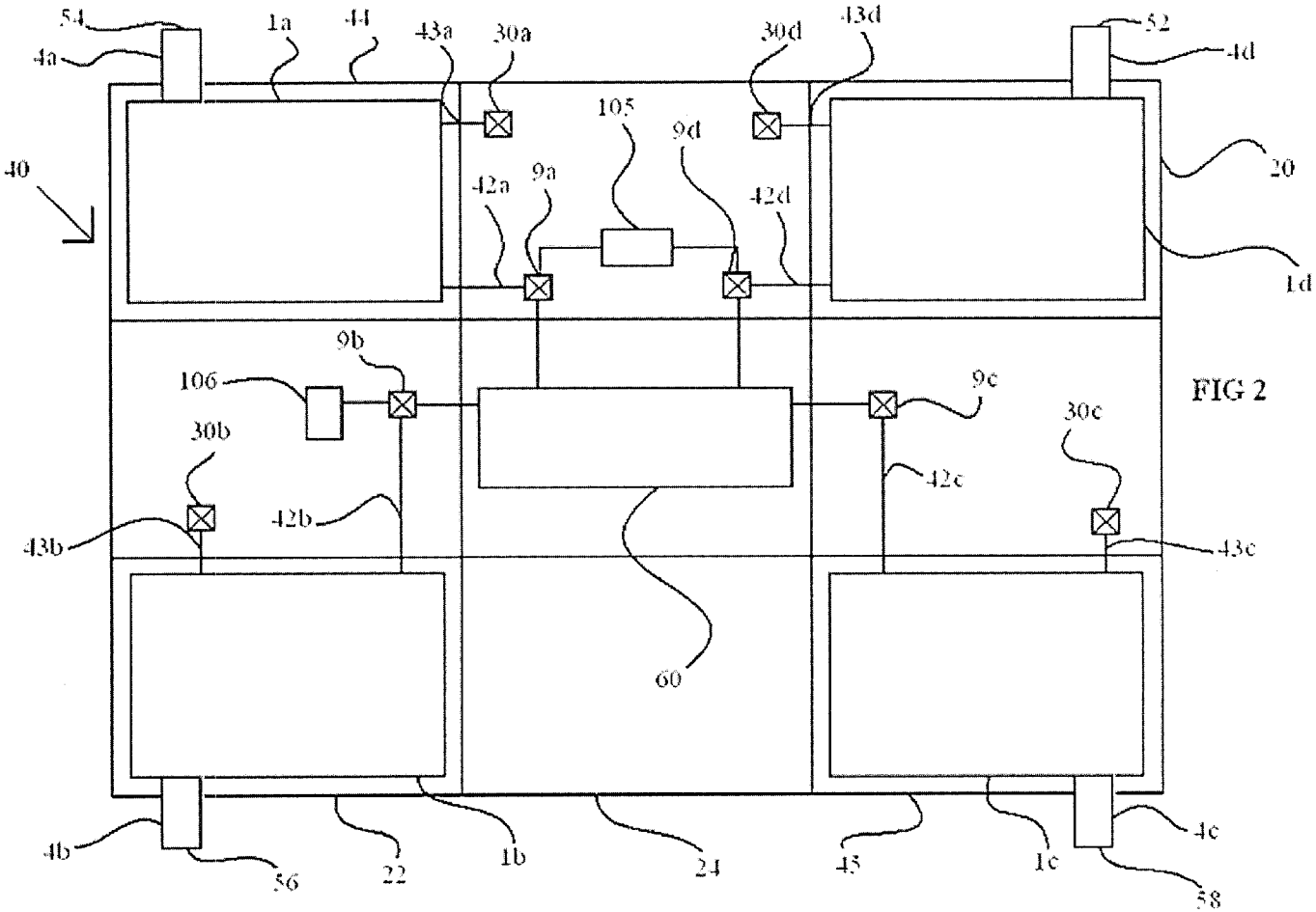
FIG. 2 depicts a top view of a four column semi-submersible.

It should be noted that the invention contemplates a semi-submersible vessel having only three columns, or as shown in FIG. 2, four columns, 20, 22, 44, and 45. This invention could also be able to be installed on other semi-submersible vessels made with 5, 6, 7, 8, 9 and up to 30 columns. It is contemplated that more columns might be usable on a semi-submersible if they are small in diameter.

Each column has a bottom end that extends downwardly into water toward the sea floor 100 when in the operational position.

The columns preferably all have the same shape. If viewed in the cross section of FIG. 1, the shapes of the columns can be square, cylindrical, rectangular, or triangular in shape. It is contemplated that an embodiment might have two columns, each of the same shape, but pairs of columns being different shapes.

Continuing with FIG. 1, in stabilizing column 20 there is a first void tank 5*a* and a second void tank 5*b*. Stabilizing column 22 has a third void tank 26. The first void tank 5*a* is above the sea surface 25.

In column 20 there is an additional active variable ballast compartment 2 which is used for normal ballasting operations as required to correct eccentricities in deck 24 caused by moving equipment and supplies and other operations, and also to stabilize the semi-submersible vessel 40 from a listing position caused by leakage into another portion of vessel 40.

The active variable ballast compartment 2 can be of any conventional type with preference for an error-proof "over the top" ballast system where the ballasting is done by seawater from a topsides-mounted pump manifold and deballasting using submersible pumps. Alternatively, an active variable ballast compartment can be operated by an air over water mechanism such as those used for an emergency ballast system. In an embodiment, each column can have one active variable ballast compartment and one compartment for emergency ballast.

Continuing with FIG. 1, in stabilizing column 20, an emergency water ballast compartment 1 is located at the base of column 20, below the active variable ballast compartment 2. During normal operations, emergency water ballast compartment 1 is flooded. In an embodiment, both the emergency ballast compartment 1 and the active variable ballast compartment 2 may be flooded, creating an interior water level 12.

Emergency water ballast compartment 1 includes a port 4 located through the column from the emergency water ballast compartment 1 to the sea. Port 4 allows seawater to exit and re-enter emergency water ballast compartment 1. Optionally, port 4 can include a port cover 52. Port cover 52 is adapted to prevent reentry of water into emergency water ballast compartment 1 after it is evacuated, and to prevent emergency ballast compartment 1 from rusting out when void of water.

A pressurized air source 8 is located above the waterline 25, near the top of stabilizing column 20. A pressurized air inlet line 42 is connected to pressurized air source 8 and emergency water ballast compartment 1 for the purpose of flowing pressurized air into emergency water ballast compartment 1. Control valve 9 is connected to pressurized air inlet line 42 for allowing air entry to emergency water ballast compartment 1. Control valve 9 regulates the airflow from pressurized air source 8 to the emergency water ballast compartment 1.

A sensor 32 may optionally be connected to control valve 9 for the purpose of actuating control valve 9 if sensor 32 detects that the vessel 40 is tilting, listing, or otherwise destabilizing beyond a preset limit.

When sensor 32 detects tilting, listing, or other destabilization beyond the preset limit, control valve 9 is actuated, causing pressurized air source 8 to flow pressurized air to pressurized air inlet line 42 and then to emergency water ballast compartment 1, causing water to be expelled through port 4. Emergency water ballast compartment 1 is then emptied, at least in part, of water, such that the presence of air within stabilizing column 20 causes vessel 40 to stabilize, and readjust. Simultaneously with use of the emergency water ballast compartment 1, in an embodiment, the active variable ballast compartment 2 can be emptied with air from pressurized air source 8 or using pumps to additionally assist in stabilizing the vessel 40.

A pressurized air evacuation line 43 is connected to emergency water ballast compartment 1 for the purpose of removing air from emergency water ballast compartment 1. A vent 30 is connected to pressurized air outlet line 43 to allow air to be released, and to allow water to reenter emergency water ballast compartment 1.

It is contemplated that the emergency system can right a vessel in a short time. If a standard construction compressor is used as the pressurized air source, the operation would take from two to four hours. If a high pressure air source is used, it would take approximately ten minutes to right a vessel.

Referring now to FIG. 2, a top view of vessel 40 is depicted. Semi-submersible vessel 40 is shown having four stabilizing columns, 20, 22, 44, 45, located at each corner of vessel 40. Columns 20, 22, 44, 45 are connected by a deck 24 at the top of the columns.

Stabilizing column 20 has an emergency water ballast compartment 1*d*. Stabilizing column 22 has an emergency water ballast compartment 1*b*. Stabilizing column 44 has an emergency water ballast compartment 1*a*. Stabilizing column 45 has an emergency water ballast compartment 1*c*. The placement and operation of emergency water ballast compartments 1*a*, 1*b*, 1*c*, 1*d* are at the portion of the columns closest to the sea floor as previously depicted in FIG. 1.

Pressurized air source 60 is located near the tops of each of columns 20, 22, 44, 45.

A pressurized air inlet line 42*d* connects pressurized air source 60 to column 20. A pressurized air inlet line 42*b* connects pressurized air source 60 to column 22. A pressurized air inlet line 42*a* connects pressurized air source 60 to column 44. A pressurized air inlet line 42*c* connects pressurized air source 60 to column 45.

Control valve 9*a* is connected to pressurized air inlet line 42*a*. Control valve 9*b* is connected to pressurized air inlet line 42*b*. Control valve 9*c* is connected to pressurized air inlet line 42*c*. Control valve 9*d* is connected to pressurized air inlet line 42*d*. Control valves 9*a*, 9*b*, 9*c*, 9*d* regulate the airflow from pressurized air source 60 to the emergency water ballast compartments 1*a*, 1*b*, 1*c*, 1*d*. Optionally, a sensor 105 may be connected to one or all of control valves 9*a*, 9*b*, 9*c*, 9*d* for the purpose of actuating control valves 9*a*, 9*b*, 9*c*, 9*d* if the sensor detects that the vessel 40 is tilting, listing, or otherwise destabilized beyond a preset limit. Separate additional sensors may be connected to each selected control valve, shown as sensor 106, or a single sensor may be connected to multiple control valves.

A pressurized air evacuation line 43*a* is connected to emergency water ballast compartment 1*a* for the purpose of removing air from emergency water ballast compartment 1*a* and allowing water to reenter emergency water ballast compartment 1*a*. A pressurized air evacuation line 43*b* is connected to emergency water ballast compartment 1*b* for the purpose of removing air from emergency water ballast compartment 1*b* and allowing water to reenter emergency water ballast compartment 1*b*. A pressurized air evacuation line 43*c* is connected to emergency water ballast compartment 1*c* for the purpose of removing air from emergency water ballast compartment 1*c* and allowing water to reenter emergency water ballast compartment 1*c*. A pressurized air evacuation line 43*d* is connected to emergency water ballast compartment 1*d* for the purpose of removing air from emergency water ballast compartment 1*d* and allowing water to reenter emergency water ballast compartment 1*d*.

A vent 30*a* is connected to pressurized air outlet line 43*a* to allow evacuated air to be released into the environment. A vent 30*b* is connected to pressurized air outlet line 43*b* to allow evacuated air to be released into the environment. A vent 30*c* is connected to pressurized air outlet line 43*c* to allow evacuated air to be released into the environment. A vent 30*d* is connected to pressurized air outlet line 43*d* to allow evacuated air to be released into the environment.

In an embodiment, the spaced apart columns can present an overall shape that is circular, rectangular, square, or triangular. Each individual column can be circular in cross section, rectangular, square or triangular. FIGS. 1 and 2 depict the columns as rectangular.

The columns are shown in this embodiment to be in a spaced apart relationship, that is edge to edge at least 1.5 times the diameter of one of the columns. One reason for this spacing is to achieve good Vortex Induced Vibration (VIV) performance and simplify the strake design.

The invention can be used on standard drilling or production semi-submersible structures, which typically have a service and storm draft of seventy feet or less, but it is contemplated that the invention can be used on deep draft semi-submersible structures, which have a service and storm draft of greater than seventy feet.

While these embodiments have been described with emphasis on the embodiments, it should be understood that within the scope of the appended claims, the embodiments might be practiced other than as specifically described herein.

What is claimed is:

1. A semi-submersible drilling or production vessel comprising:

a plurality of stabilizing columns each having a top and bottom;

a deck disposed between the tops of the plurality of stabilizing columns forming a vessel with a waterline;

at least one void tank in at least one stabilizing column;

at least one active variable ballast compartment disposed below the at least one void tank in the at least one stabilizing column containing the at least one void tank;

at least one emergency water ballast compartment disposed at the bottom of the at least one stabilizing column below the at least one active variable ballast compartment and below the at least one void tank, wherein the at least one emergency water ballast compartment is a pressure equalized tank and is flooded during normal operating conditions;

a pressurized air source disposed above the waterline near the tops of the plurality of stabilizing columns, wherein the pressurized air source is adapted for expelling water from the emergency ballast compartment;

at least one control valve connected to the pressurized air source for rapidly passing air into the emergency water ballast compartment; and at least one port in the emergency water ballast compartment for expelling water from the emergency water ballast compartment.

2. The semi-submersible drilling or production vessel of claim 1, wherein the control valve is connected to at least one sensor for actuating the control valve to stabilize the vessel when the vessel lists over a preset limit.

3. The semi-submersible drilling or production vessel of claim 1, wherein the emergency water ballast compartment is disposed on each of the corner columns of an at least four-column semi-submersible drilling or production vessel.

4. The semi-submersible drilling or production vessel of claim 1, further comprising at least one port cover disposed over the at least one port wherein the port covers are adapted to prevent reentry of water into the emergency water ballast compartment.

5. The semi-submersible drilling or production vessel of claim 1, further comprising an air pump for pressurizing air for expelling the water in the emergency water ballast compartment.

6. The semi-submersible drilling or production vessel of claim 1, wherein the water in the emergency water ballast compartment is expelled.

7. The semi-submersible drilling or production vessel of claim 1, wherein the void tank is disposed above and below a water line of the vessel.

8. The semi-submersible drilling or production vessel of claim 1, wherein at least one vent is connected to the emergency water ballast compartment for expelling the air passed into the emergency water ballast compartment.

9. The semi-submersible drilling or production vessel of claim 2, wherein the at least one sensor engages a processor with memory and computer instructions having present limits on listing of the vessel, and wherein the control valve is actuated by the processor automatically when the at least one sensor provides data to the computer instructions to indicate the vessel has listed past the preset limit.

* * * * *